United States Patent [19]

Schultes

[11] Patent Number: 4,682,616

[45] Date of Patent: Jul. 28, 1987

[54] UMBRELLA WITH A MECHANISM FOR LOCKING AND RELEASING A SLIDER

[75] Inventor: Tilmann Schultes, Solingen, Fed. Rep. of Germany

[73] Assignee: Kortenbach Verwaltungs- und Beteiligungsgesellschaft mbH & Co., Solingen, Fed. Rep. of Germany

[21] Appl. No.: 903,144

[22] Filed: Sep. 3, 1986

[30] Foreign Application Priority Data

Sep. 7, 1985 [DE] Fed. Rep. of Germany ..... 3531952

[51] Int. Cl.[4] ..... A45B 25/14; A45B 25/08

[52] U.S. Cl. ..... 135/38; 135/22; 135/24

[58] Field of Search ..... 135/38, 22, 23, 24

[56] References Cited

U.S. PATENT DOCUMENTS

| | | | |
|---|---|---|---|
| 257,872 | 5/1882 | Iehl | 135/38 |
| 1,902,363 | 3/1933 | Haupt | 135/22 |
| 1,991,385 | 2/1935 | Geisel | 135/22 X |
| 2,725,888 | 12/1955 | Haupt | 135/38 |
| 4,418,707 | 12/1983 | Wu | 135/24 |
| 4,573,487 | 3/1986 | Schultes | 135/24 |

FOREIGN PATENT DOCUMENTS

| | | | |
|---|---|---|---|
| 126445 | 1/1932 | Australia | 135/22 |
| 654150 | 12/1962 | Canada | 135/38 |
| 840757 | 5/1970 | Canada . | |
| 2852998 | 6/1980 | Fed. Rep. of Germany | 135/24 |
| 504324 | 12/1954 | Italy | 135/38 |
| 95549 | 2/1960 | Norway | 135/24 |
| 6436 | of 1904 | United Kingdom | 135/24 |

*Primary Examiner*—J. Karl Bell

*Attorney, Agent, or Firm*—Samuel Meerkreebs

[57] ABSTRACT

An umbrella has a mechanism for latching and releasing a slider (8) which actuates the umbrella canopy framework as it slides to and fro along a stick (12). The slider is fixed in the closed position by means of a latching bolt (18) which is mounted in a handle (1) and has a latching nose engaging in a notch (8*b*) in a guide sleeve (8*c*) of the slider. The slider is released by pressing a button (15) which causes the bolt (18) to slide transversely to the axis (X) of the stick against the action of a spring (17).

5 Claims, 7 Drawing Figures

UMBRELLA WITH A MECHANISM FOR LOCKING AND RELEASING A SLIDER

The invention relates to an umbrella (hereinafter referred to as of the kind described) having a framework for supporting a canopy and a mechanism for locking and releasing a slider which slides along a stick upon opening and closing of the framework, and which is fixable in the closed position of the frame by means of a latching member engaging in a notch and being releasable from the notch by manual means.

It has hitherto been known to equip shortenable and non-shortenable umbrellas, which may be opened and/or closed manually or automatically, with such slider-latching mechanisms. Such mechanisms have, for example, spring-loaded latching levers, or latching members which may be released manually by means of handles fitted to them, or else via handles which are coupled through suitable geared means indirectly to the latching member. The latching members are usually arranged either in the umbrella stick or in the umbrella slider and cooperate either with a notch in the slider or stick as shown, for example, in CA-A-840,757 or U.S. Pat. No. 2,725,888. All of the umbrellas known hitherto having such mechanisms require space for arranging them within the umbrella stick or at least opening or slitting of the wall of the umbrella stick near to the lower end. These requirements weaken the umbrella stick and make the stick accessible in its interior to injurious corrosive influences and furthermore require space for accomodating driving parts just where it is often not available, for example, in the case of self-opening or self-closing umbrellas.

The object of the invention is to create an umbrella of the kind described having a mechanism which latches and releases the slider, and which, for its accomodation or operation, does not require any space in the stick or an opening or slit in the wall of the stick.

This problem is solved in accordance with the invention if the latching member consists of a bolt which is carried by a handle at a lower end of the stick and has a ring part surrounding a guide sleeve of the slider in the closed position and engagable in a notch in the guide sleeve, the bolt being disengagable from the guide sleeve upon being slid transversely to the axis of the umbrella stick against spring action.

An umbrella is thereby created, of any shortenable or non-shortenable construction, having for the latching and release of the umbrella slider in the closed position of the umbrella canopy a mechanism which, for its arrangement and operation, needs neither a catch in the umbrella stick nor space for it. The stick is not thereby weakened in its bottom portion through slits for catches or the like, or exposed through them to corrosive influences in its interior. Furthermore the whole cavity in the bottom region of the stick is free from components of the slider latching, so that this free cavity is available, if necessary, for the arrangement of components necessary for other purposes, for example, for incorporating an opening spring for the telescopic stick of a self-opening umbrella.

The invention is explained in greater detail by way of two examples with reference to the accompanying drawings, in which.

Figures 1, 2, 3, 4:
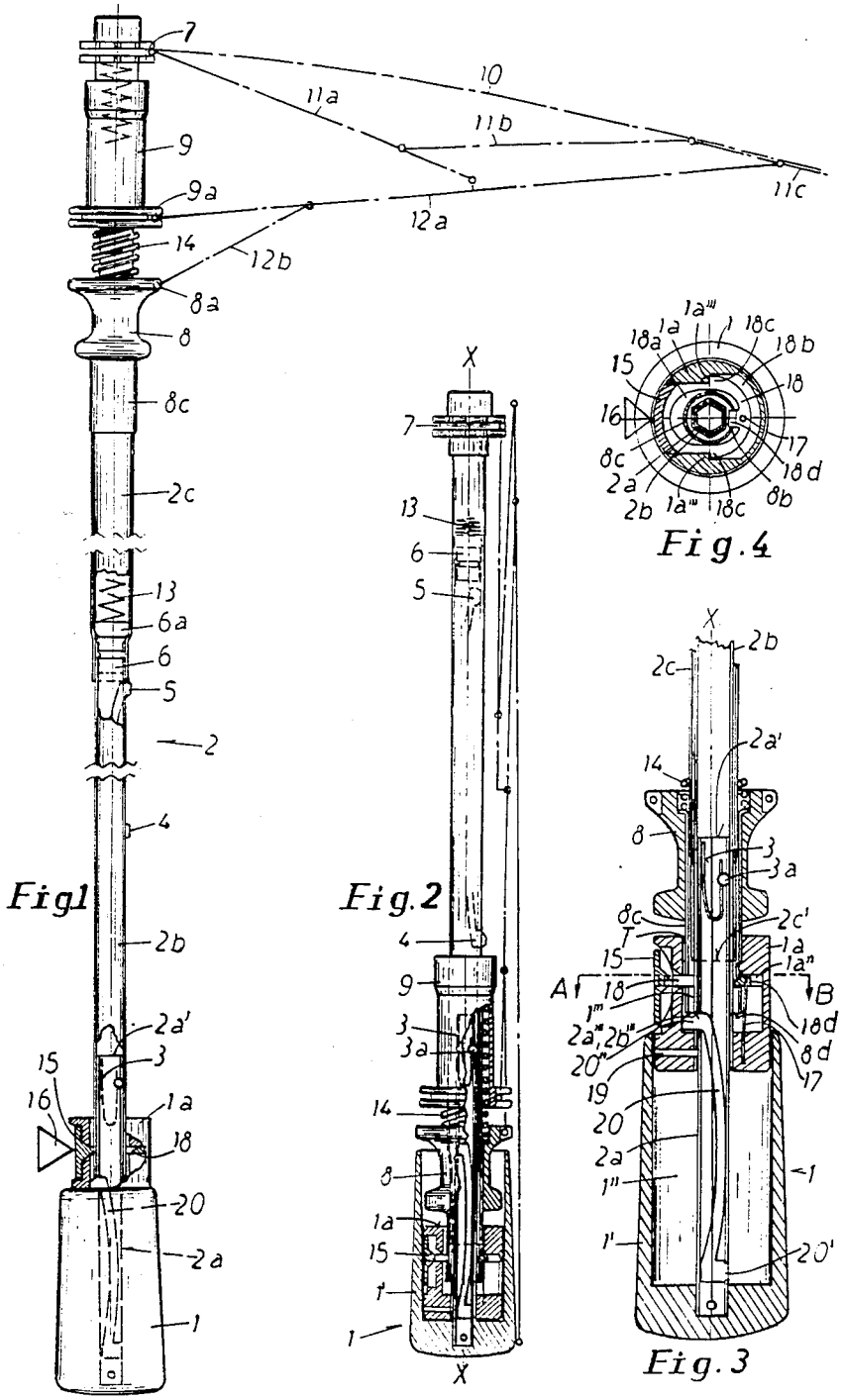
FIG. 1 is a diagrammatic side view of an umbrella of automatically opening construction, in the opened state.
FIG. 2 is a view corresponding to FIG. 1 but partially sectioned and with the umbrella in the closed state.
FIG. 3 is an enlarged axial section through the bottom part of the umbrella.
FIG. 4 is a section taken on the line A-B in FIG. 3.

FIGS. 1 to 6 show, by way of example, an umbrella of shortenable and self-opening construction but the invention is also applicable to any other construction of umbrella of non-shortenable or shortenable type which is opened and/or closed manually or automatically, provided that a mechanism is required for the latching and release of a slider in the closed position of the umbrella canopy. Thus the stick too of such an umbrella may at option be telescopic in a number of parts or else be in only one piece and rigid.

The illustrated umbrella has a handle 1 at the bottom end of a telescopically shortenable stick 2. The handle 1 is fixed to a bottom member of the stick, i.e. to a piece of tube 2*a* forming a lowermost stick part, which is received in a piece of tube 2*b* forming a next lowermost stick part, which in turn is received in a piece of tube 2*c*. The pieces of tube 2*a*, 2*b* and 2*c* of the stick may be received in one another so as to be secure against relative turning by means of hexagonal cross-sections (FIG. 4) or, in the case of a round cross section, by means of longitudinal guide grooves, and in their pulled-out and/or pushed-together positions are secured with respect to one another by catches 3, 4 and 5. The catch 3 secures the piece of tube 2*a* in the pushed-in position in the piece of tube 2*b*, the catch 4 secures the piece of tube 2*b* in the piece of tube 2*c* in the pushed-in position and the catch 5 secures the piece of tube 2*c* in the pushed-out position to the piece of tube 2*b*. A plug 6 seated at the top end of the piece of tube 2*b* has an annular shoulder 6*a* so that the pieces of tube 2*b*, 2*c* cannot be separated from one another. The piece of tube 2*a* ends at an edge 2*a*' in the piece of tube 2*b* and the piece of tube 2*c* reaches at its bottom edge 2*c*' into the handle 1 in the closed position. At the top end of the piece of tube 2*c* is seated a crown 7. Onto the latter as well as onto crowns 8*a* and 9*a* of two sliders 8 and 9, which are able to slide up and down the stick 2, are hinged in a star-shaped arrangement, a ring of canopy spokes 11*a*, 11*b*, 11*c* supporting a fabric canopy 10 and their struts 12*a*, 12*b*, the spokes and struts forming a framework.

Kinematically, this framework is automatically opened, and at the same time the stick 2 is automatically telescoped out, by a compression spring 13, which is stressed between the crown 7 and the piece of tube 2*b* and tries to force the pieces of tube 2*b* and 2*c* apart, and by the sliders 8, 9, which are loaded against one another by a further compression spring 14 and thus have the tendency to be forced upwards as soon as a release button 15 is pressed in transversely, i.e. radially, to the axis X of the stick in the direction of the arrow 16 (FIGS. 1, 4). The release button 15 is a finger- or thumb-actuated part of a bolt 18 of a mechanism for the latching and release of the slider 8 in the closed position of the umbrella canopy (FIGS. 2–5). The bolt 18 is supported so as to be able to slide transversely to the axis X of the stick against the action of a spring 17 inside a portion 1*a* of the handle 1.

The bolt 18 has a ring part with an oval opening 18*a* surrounding a guide sleeve 8*c* of the slider 8 as well as the pieces of tube 2*a* and 2*b*, with a corresponding clearance near the release button 15, the bolt sliding in a bearing in a slide channel 1*a*″ in the portion 1*a*. The slide channel 1*a*″ has a clearance 18*b* corresponding to the clearance in the oval 18*a*, as well as stop corners 1*a*‴ for engaging stop edges 18*c* on the bolt 18 (FIG. 4). In this way a latching nose 18*d* of the bolt 18 engages, under the action of the spring 17, in a latch opening or notch 8*b* in the guide shank 8*c* of the slider 8 in the closed position of the umbrella canopy in readiness for release of this latch mechanism, and may be slid by means of the release button 18, against the spring action in the direction of the arrow 16 and thereby disengaged out of the latch opening 8*b* in the slider 8, with the result that the slider 8 and the slider 9 are released and, under the action of the spring 14, move upwards along the stick 2 in the opening direction. In doing so the sliders 8, 9 slide over the stick catch 4 so that it gets presssed in sufficiently for the two pieces of tube 2*b* and 2*c* to be freed for telescoping apart under the action of the spring 13.

The portion 1*a* of the handle 1 supporting the bolt 18 is fixed to the piece of tube 2*b* by a pin 19 and is thereby connected to the piece of tube 2*b* so as to move with it. The bottom part of the handle 1 has a cavity 1″ conforming to the contour of the portion 1*a* and forms a grip sleeve 1′, in which the lower end of the piece of tube 2*a* is fixed, and which, upon the sliding of the piece of tube 2*a* into the piece of tube 2*b* in the direction of an additional shortening of the umbrella stick, may be pushed over the portion 1*a* as well as over the slider 8 as shown in FIG. 2. With this telescopic handle arrangement is associated a springy latching hook 20, which is fixed in the piece of the tube 2*a*, and secures the portion 1*a* against separation from the grip sleeve 1′, irrespective of the pulled-out position of the piece of tube 2*a* from the piece of tube 2*b*. The arrangement of this mechanism is only possible because, for the arrangement and construction of the mechanism 15–18 for the latching and release of the slider 8, no space of corresponding deformations are necessary in the stick 2. Consequently instead of the telescopic handle arrangement, or instead of the latch 20 one might obviously, for example, also build a spring element for the telescoping of the pieces of tube 2*a*, 2*b* into the aforesaid free space.

The latching hook 20 is fixed into the piece of tube 2*a* by means of a claw 20′ and, after the umbrella has been closed by pulling down the slider 8 by hand, with consequent latching by the catch 4 of the two pieces of tube 2*b*, 2*c* loaded against one another by the spring 13, without any outlay upon additional components, that is, by the means already available as well as without the observance of any extraordinary conditions of operation, the hook is released to allow additional shortening of the umbrella. Unintentional actuation of the release button 15 and opening of the umbrella, is also avoided as the grip sleeve 1′ is slid over and covers the button and the portion 1*a* as well as the slider 8, as shown in FIG. 2.

Figure 5:
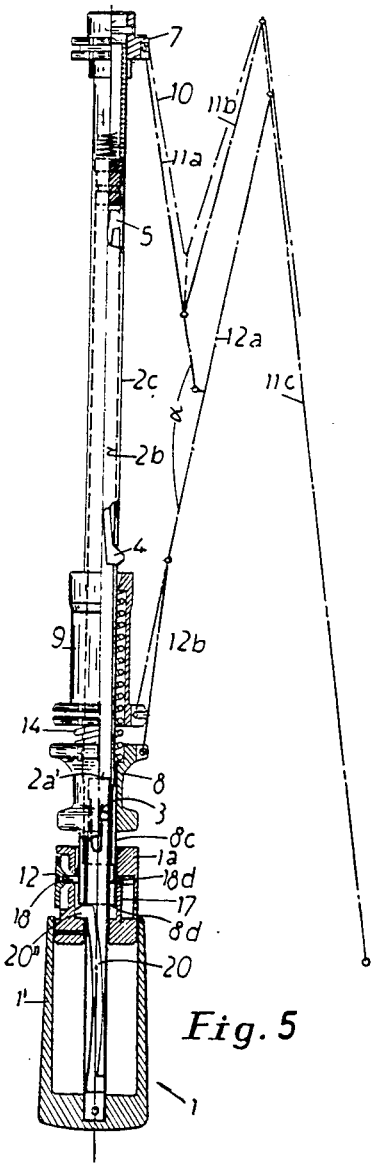
FIG. 5 is a view corresponding to FIG. 2 but with the umbrella in the nearly closed state.
Figure 6:
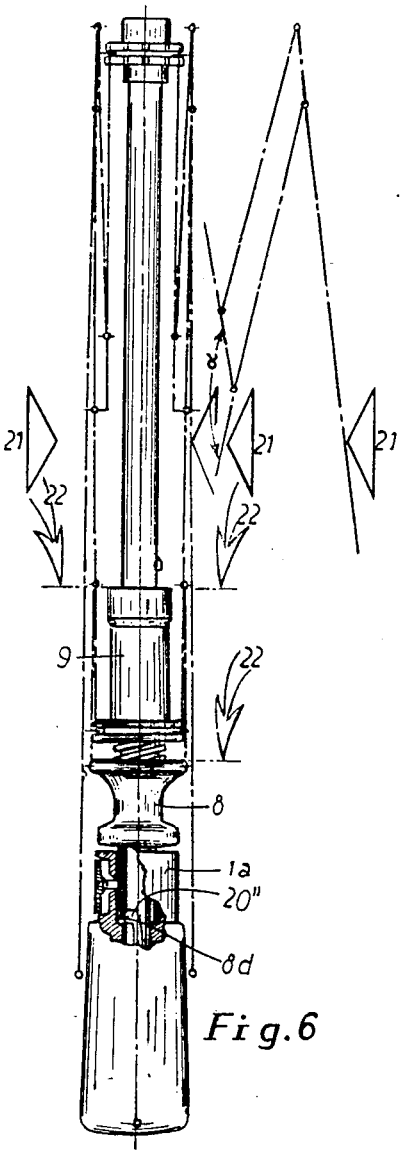
FIG. 6 is a view corresponding to FIG. 5 but with the umbrella in the fully closed state.

The set of canopy spokes, and their struts, because of their unavoidable compressive and tensile stresses do not exactly, upon closing the umbrella become nicely bundled against the stick 2, parallel to the stick, and resting appropriately against it, but retain a certain residual spread away from the stick 2 at, say, at an angle of kink $\alpha$ (FIGS. 5, 6). The user of the umbrella for his part eliminates this residual spread uniformly without any special observance of an instruction, by clasping the set of canopy spokes with the folded canopy 10 and pressing them together so that a bundling and folding of the umbrella in parallel with the stick, ready to go in its sheath, comes about. In the course of this uniform bundling by hand the set of canopy spokes, with the canopy 10, get pressed together towards the axis X of the stick in the direction of the arrow 21 (FIG. 6) to run in parallel with the stick 2, with accompanying increase in the residual angle of kink and in compensation gets stretched or elongated a little in the direction of the handle 1 i.e. in the direction of the arrow 22. The sliders 8 and 9 connected to the set of canopy spokes carry out this strectching or elongation with them, with the result that the slider 8 lying with the end 8*d* of its guide sleeve 8*c* in front of a latching nose 20″ rides over latching nose 20″ and forces the latter so far into the piece of tube 2*a* that the latching nose 20″, upon pushing the grip sleeve 1′ upwards, no longer engages in the latch openings 2*a*‴, 2*b*‴ in the pieces of tube 2*a*, 2*b* so as to lock them, but with the aforesaid upwards push slides during the nesting of the piece of tube 2*a* in the piece of tube 2*b* inertly against the inner wall of the latter until a ball 3*a* of the catch 3 drops into a notch in the piece of tube 2*b* and the nesting of the piece of tube 2*b* ends up in a position corresponding with that shown in FIG. 2. As may further be seen from that, through the sliding of the grip sleeve 1′ over the parts 1*a* and 8, the release button 15 is completely enclosed, i.e. concealed from any contact, and in this way release of the umbrella by mistake is quite impossible. This is possible again only when the grip sleeve 1′ is pulled downwards again during the course of elongation of the stick. In doing so the piece of tube 2*a*, together with the latching hook 20, get pulled out of the piece of tube 2*b* until its latching nose 20″ again snaps through the latch openings 2*a*‴, 2*b*‴ and thus the pieces of tube 2*a* and 2*b* pulled out with respect to one another get latched together and at the time the slider 8 and the portion 1*a* of the handle with the release button 15 become exposed again ready for release, corresponding with the position shown in FIGS. 1 and 3 to 6.

Figure 7:
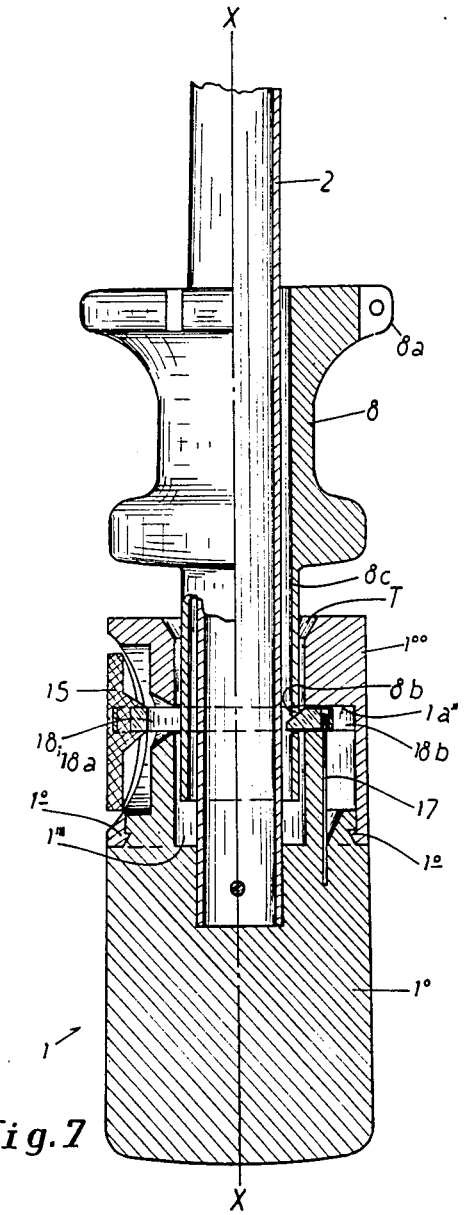
FIG. 7 is an enlarged axial section of the bottom part of the second example of umbrella.

The mechanism described above for the latching and release of the slider 8 in the closed position of the umbrella is thus a mechanism which, without any involvement of space for arrangement or refinements in or on the stick 2, is realized through a direct latching and release between the handle 1 and the slider 8. Since this latching may be realized without dependence upon any particular shortenable or non-shortenable construction of umbrella, it may, for example, be utilized in combination with a simple non-telescopic handle 1 or a one piece non-telescopic stick 2, corresponding with the example shown in FIG. 7. In the latter the same reference numbers apply to the same parts as in the FIGS. 1 to 6 example. A like transverse bolt 18 may be actuated here too transversely, i.e. radially, to the axis X of the stick 2 by means of a release button 15, so that here too through the arrangement of the bolt 18 on the handle 1, and through its surrounding, in the form of a ring, the guide sleeve 8*c* of the slider 8, as well as through its engagement in the latch opening 8*b* on the guide shank 8*c*, a direct latching of the slider 8 onto the handle 1 results without any involvement of the stick 2. The bolt 18, supported to be able to slide in the slide channel 1*a*″, is held by a wire spring 17 with the latching nose 18*d* engaged in the latch opening 8*b* and hence may be disengaged against spring pressure. The handle 1 may consist of two parts, namely, a bottom part 1° and a top part 1°°, where these two parts may be so designed that they are connected together separably by means, for example, of snap noses or edges 1° or other suitable detachable means of connection, in order to be able to define between them the slide channel 1*a*″ and to mount the bolt 18 and the spring 17 to be easily accessible.

In order that the slider 8, during the course of the closing i.e. folding together of the umbrella, out of the open state of the umbrella in accordance with FIG. 1, may run with less friction of the guide sleeve 8*c* into the portion of handle 1*a*, i.e. into the top part 1°°, the annular channel 1‴ in this portion of handle, which receives the guide sleeve 8*c*, may be provided with a funnel-shaped entry T.

I claim:

1. In an umbrella of the kind having a stick; a handle at a lower end of said stick; a canopy framework which is adapted to support a canopy and which is opened and closed by means of a slider which slides to and fro along said stick; and manually releasable latching means for fixing said slider in the closed position of said canopy framework, said means comprising a latching member engagable in a notch; the improvement wherein said notch is provided in a guide sleeve of said slider and said latching member comprises a bolt which is carried by said handle and has a ring part surrounding said guide sleeve in said closed position and engagable with said notch; said bolt being slidable transversely to the axis of said stick against spring action for disengagement thereof from said guide sleeve.

2. An umbrella according to claim 1, wherein said handle is provided by two detachably connected parts, and said bolt is guided betweem said two parts.

3. An umbrella according to claim 1, wherein said handle is provided by first and second portions, said bolt being mounted in said first handle portion which forms a grip sleeve, and said second handle portion being slidable over said first handle portion to cover said bolt.

4. An umbrella according to claim 3, wherein said first handle portion is provided with an annular channel for receiving said guide sleeve of said slider and with a funnel-shaped entry for guiding said guide sleeve centrally into said annular channel.

5. An umbrella according to claim 3, wherein said stick comprises at least lowermost and next lowermost tubular stick parts each formed with a latch opening, said lowermost stick part being received telescopically in said next lowermost stick part, said lowermost stick part being fixed to said second handle portion and said next lowermost stick part being fixed to said first handle portion; and wherein a springy latching-hook having a latching nose is contained in said lowermost stick part, said latching nose being adapted to engage through both said latch openings to latch said lowermost and next lowermost stick parts in a mutually telescopically extended position and to be disengaged therefrom upon final sliding of said guide sleeve of said slider down said stick against said locking nose when, in the course of final closing of said framework, said framework and, in use, a canopy supported thereby is manually bundled around, and compressed towards, said stick.

* * * * *